US011083276B2

(12) United States Patent
Parlionas

(10) Patent No.: US 11,083,276 B2
(45) Date of Patent: Aug. 10, 2021

(54) RESILIENT CONTAINER HOLDER

(71) Applicant: Evangelia Parlionas, College Point, NY (US)

(72) Inventor: Evangelia Parlionas, College Point, NY (US)

( * ) Notice: Subject to any disclaimer, the term of this patent is extended or adjusted under 35 U.S.C. 154(b) by 0 days.

(21) Appl. No.: 15/289,105

(22) Filed: Oct. 7, 2016

(65) Prior Publication Data

US 2017/0150801 A1 Jun. 1, 2017

Related U.S. Application Data

(60) Provisional application No. 62/238,251, filed on Oct. 7, 2015.

(51) Int. Cl.

| | |
|---|---|
| ***A45D 40/18*** | (2006.01) |
| ***A63H 3/00*** | (2006.01) |
| *A45D 40/00* | (2006.01) |
| *A45F 5/00* | (2006.01) |

(52) U.S. Cl.

CPC ..... *A45D 40/18* (2013.01); *A63H 3/003* (2013.01); *A63H 3/005* (2013.01); *A45D 2040/0012* (2013.01); *A45F 2005/006* (2013.01)

(58) Field of Classification Search

CPC ..... A45D 40/18; A45D 40/00; A63H 3/005; A63H 3/003; B65D 25/22; B65D 25/02; B65D 51/242; B65D 51/24

USPC ..... 220/212, 751, 737, 754, 752, 694; 206/581, 223; 16/428, 422; 401/131, 52

See application file for complete search history.

(56) References Cited

U.S. PATENT DOCUMENTS

| | | | | | |
|---|---|---|---|---|---|
| 1,630,566 | A * | 5/1927 | Friedman | A45D 40/18 | 401/51 |
| 2,309,544 | A * | 1/1943 | Scharff | A45D 40/18 | 132/316 |
| 2,538,155 | A * | 1/1951 | Henneman | B43K 25/00 | 24/10 R |
| 3,768,684 | A * | 10/1973 | Buchtel | A61M 5/1417 | 215/399 |
| 4,733,807 | A * | 3/1988 | Porter | B65D 25/22 | 206/37 |
| 5,979,468 | A * | 11/1999 | Blake, III | A45D 40/06 | 132/317 |
| 6,481,590 | B1 * | 11/2002 | Simkins | A45F 5/00 | 215/12.1 |
| 2005/0017004 | A1 * | 1/2005 | Schlatter | A44B 15/005 | 220/212 |
| 2005/0176337 | A1 * | 8/2005 | Beer | A45C 11/38 | 446/71 |
| 2006/0011660 | A1 * | 1/2006 | Sandlin | B05B 11/0038 | 222/321.9 |

(Continued)

*Primary Examiner* — Robert J Hicks

(74) *Attorney, Agent, or Firm* — Charu Narang, Esq.

(57) ABSTRACT

A holder for a container, the holder comprised of a perimeter, wherein said perimeter defines an interior space, and wherein the interior space is comprised of a container holding portion and an attachment housing portion, wherein the container holding portion includes a cavity conforming to the container, wherein the container is retained in the holder in a non-removable manner, and wherein the container includes a cap portion and the cap portion is not covered by the holder, and wherein the attachment housing portion attaches the holder to an external object and wherein said holder is comprised of a resilient material.

4 Claims, 3 Drawing Sheets

(56) References Cited

U.S. PATENT DOCUMENTS

| | | | | |
|---|---|---|---|---|
| 2006/0239755 | A1* | 10/2006 | Kremizis | A45F 5/004 401/131 |
| 2007/0166095 | A1* | 7/2007 | Samuelson | A45F 5/004 401/131 |
| 2009/0107868 | A1* | 4/2009 | Mercier | A61F 13/5511 206/438 |
| 2015/0320178 | A1* | 11/2015 | Fish | A45D 40/00 222/1 |
| 2016/0036948 | A1* | 2/2016 | Stansberry | H04M 1/04 455/575.1 |
| 2016/0213135 | A1* | 7/2016 | Parlionas | B05B 11/0035 |

* cited by examiner

RESILIENT CONTAINER HOLDER

PRIORITY

This application claims priority from U.S. Provisional Application No. 62/238,251 filed on Oct. 7, 2015.

BACKGROUND OF THE INVENTION

Field of the Invention

The present invention relates to holders for containers. Specifically, the present invention is for a holder that fits snugly around a container and is made of a moldable, flexible, squeezable material in a predetermined shape.

Description of the Prior Art

There exist in the prior art holders for containers of a variety of shapes. However, these containers generally are made of a hard material. Such a material is subject to cracking or breaking if dropped by a user, thereby rendering the product inside the container of little use due to contamination and certainty of leakage of the product through the crack in the container and/or holder.

In addition, there exist in the prior art animal characters and pleasing shapes made of soft, flexible, moldable material to engage the hands of the user, to alleviate nervousness, anxiety, increase motor function and provide a host of other benefits.

However, there does not exist in the market a holder for a container that provides the benefits of being able to engage a user's hands and also being a practical product capable of holding a container which may include lip gloss, antibacterial lotion or any other item one would choose to place in a container. The holder of the present invention fills a need in the market presently not addressed by the prior art.

SUMMARY OF THE INVENTION

An advantage of the holder of the present invention is that it is directed to a holder for a container, said holder comprised of a perimeter, wherein said perimeter defines an interior space, and wherein said interior space is comprised of a container holding portion and an attachment housing portion, wherein said container holding portion includes a cavity conforming to the container, wherein said container is retained in the holder in a non-removable manner, and wherein said container includes a cap portion and said cap portion is not covered by the holder, and wherein said attachment housing portion is comprised of a means to attach the holder to an external object.

Another advantage of the present invention is that the holder of the present invention includes an attachment means comprised of a retractable reel assembly and a retractor cord coupled to the retractable reel assembly, wherein said retractable reel assembly is situated within the attachment housing portion of the holder, and wherein the perimeter surrounding the attachment housing portion includes an aperture communicating with the exterior of the interior space, and wherein the retractor cord is threaded through the aperture while remaining connected to the retractor reel assembly, and wherein the reel assembly permits selective movement of the holder when one pulls on the retractor cord.

A further advantage of the holder of the present invention is that the attachment means is comprised of an anchor including a securing ring, wherein the perimeter surrounding the attachment housing portion includes an aperture communicating with the exterior of the interior space which allows the securing ring to be visible on the exterior of the holder, and wherein the securing ring is capable of being fastened to a securing means.

Yet another advantage of the holder of the present invention is that the securing means is a strap.

A further advantage of the present inventions that the securing means is a retractable cord.

Another advantage of the present invention is that the holder is comprised of a moldable material.

Yet another advantage of the holder of the present invention is that the holder is comprised of a flexible material.

A further advantage of the holder r of the present invention is that the holder is comprised of a squeezable material.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
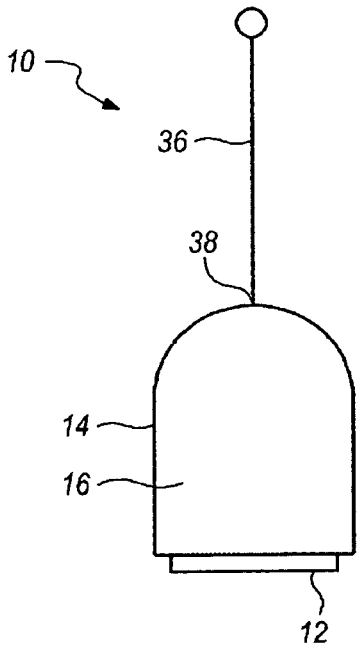
FIG. 1 is a perspective view of a first embodiment of the holder of the present invention.
Figure 2:
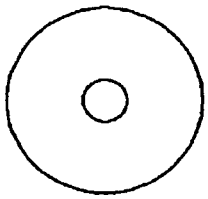
FIG. 2 is a top view of a first embodiment of the holder of the present invention.
Figure 3:
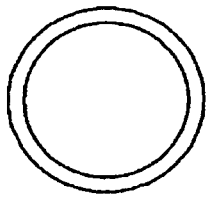
FIG. 3 is a bottom view of a first embodiment of the holder of the present invention.

With reference now to FIGS. 1-5, a first preferred embodiment for a new holder for a container embodying the principles and concepts of the present invention and generally designated by the reference numeral 10 will be described.

First Preferred Embodiment

Figure 4:
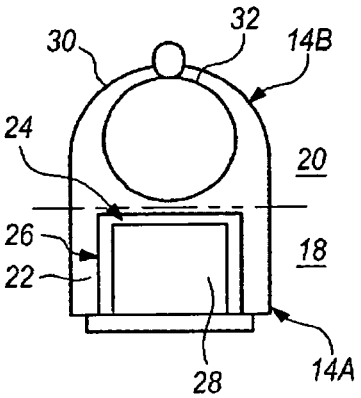
FIG. 4 is a cross-section view of a first embodiment of the holder of the present invention.
Figure 5:
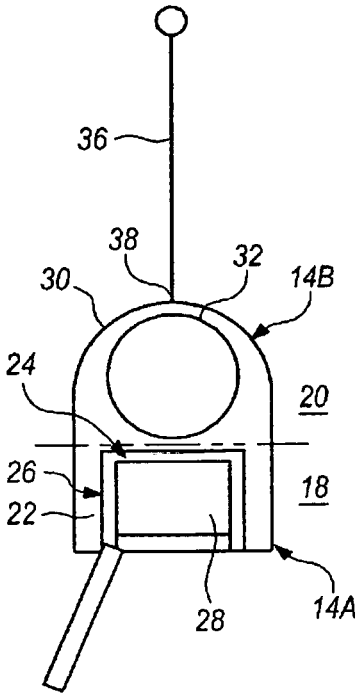
FIG. 5 is yet another cross section view of a first embodiment of the holder of the present invention.

As illustrated in FIG. 1, the holder 10 for a container 12 is fabricated from a moldable, flexible and squeezable material capable of being formed into any pre-determined shape. With reference to FIGS. 4 and 5, the holder 10 has a perimeter 14 that defines an interior space 16, which is comprised of two portions, a container holding portion 18 and an attachment housing portion 20. The perimeter 14 is divided into the container holding portion perimeter 14A and the attachment housing portion perimeter 14B. The container holding portion 18 includes a cavity 22 that is formed in a shape to conform to the shape of the container 12 it is to hold. The container 12 is comprised of a base wall 24 and a perimeter wall 26. The base wall 24 and the perimeter wall 26 define an interior space 28 for receiving any substance that may be contained therein. The container 12 further includes a cap portion 30 that is pivotably coupled to the perimeter wall 26 opposite of the base wall 24. The holder 10 is constructed of a suitable material that is capable of being molded to snugly hold the container 12 so that the container 12 does not fall out of the holder 10. The material utilized for the holder 10 is also squeezable by a user. In addition the container 12 is retained in the holder 10 in such a fashion that the cap portion 30 is not covered by the holder 10, thereby allowing a user to remove or replace the cap portion 30 on the container 12 without having to manipulate or remove the holder 10 from the container.

The attachment housing portion 20 of the holder 10 is used to accommodate a retractable reel assembly 32. The attachment housing portion 20 is defined by a portion of the perimeter 14B and the interior housing wall 34. The interior housing wall 34 functions as the base wall for the cavity 22 as well. The reel assembly 32 of the holder 10 of the present invention includes a retractor cord 36 coupled to the reel assembly 32. The reel assembly 32 permits selective movement of the holder 10 when one pulls on the retractor cord 36. The retractor cord 36, when released after being pulled, retracts back into the reel assembly.

The perimeter wall 14B of the attachment housing portion 20 includes an aperture 38 which allows the retractor cord 36 to extend within the housing portion 20 and be connected to the reel assembly 32. In this preferred embodiment, the reel assembly 32 is substantially disk shaped, although other shapes may also be employed.

Figure 6:
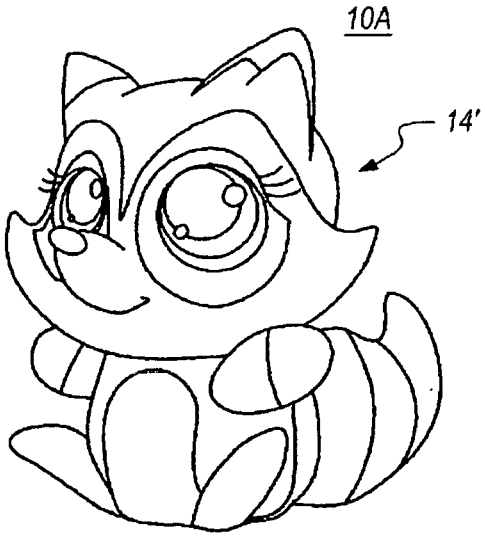
FIG. 6 is a perspective view of an alternate embodiment of the holder of the present invention.
Figure 7:
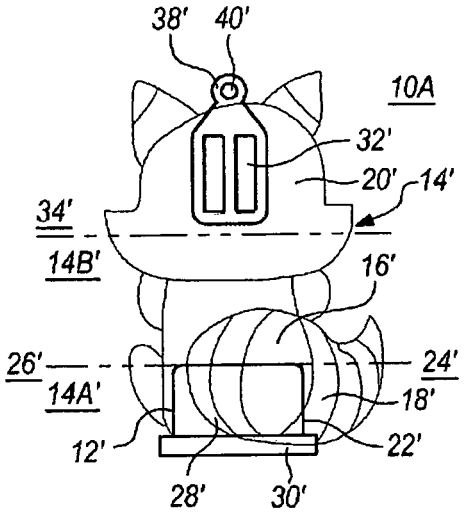
FIG. 7 is a cross-section view of an alternate embodiment of the holder of the present invention.

The holder 10 of the present invention may be formed in any predetermined shape, as shown in an alternate preferred embodiment illustrated in FIGS. 6 and 7.

An Alternate Preferred Embodiment

FIGS. 6 and 7 illustrate a holder 10A in the shape of an animal character. As in the first preferred embodiment, the holder 10A of the alternate preferred embodiment, has a perimeter 14' that defines an interior space 16', which is comprised of two portions, a container holding portion 18' and an attachment housing portion 20'. The perimeter 14' is divided into the container holding portion perimeter 14A' and the attachment housing portion perimeter 14B'. The container holding portion 18' includes a cavity 22' that is formed in a shape to conform to the shape of the container 12' it is to hold. The container 12' is comprised of a base wall 24' and a perimeter wall 26'. The base wall 24' and the perimeter wall 26' define an interior space 28' for receiving any substance that may be contained therein. The container 12' further includes a cap portion 32' that is removably coupled to the perimeter wall 26' opposite of the base wall 24'. The holder 10A is constructed of a suitable material that is capable of being molded into any pre-determined shape and to also snugly and/or non-removably hold the container 12' so that the container 12' does not fall out of the holder 10A. The material utilized for the holder 10 is also squeezable by a user. In addition the container 12' is retained in the holder 10 in such a fashion that the cap portion 30' is not covered by the holder 10A, thereby allowing a user to remove or replace the cap portion 30' on the container 26' without having to manipulate or remove the holder 10A from the container.

The attachment housing portion 20' of the holder 10A is used to accommodate an anchor 32' for a carabiner or other similar attachment. The attachment housing portion 20' is defined by a portion of the perimeter 14B' and the interior housing wall 34'. In this embodiment, the interior housing wall is thicker than in the first preferred embodiment. However, similarly, the interior housing wall 34' functions as the base wall for the cavity 22' and the other side functions to define the attachment housing portion 20'. The perimeter wall 14B' of the attachment housing portion 20' includes an aperture 38' which allows a portion of the anchor 32' to extend outside the housing portion 20' and be connected to the reel assembly 32. Specifically, the anchor 32' of the holder 10A is situated inside the attachment housing portion 20', such that only the securing ring 40' visible to the user. The securing ring 40' may be used to attach a carabiner, a strap, a clip, a lanyard, a retractable cord or any other securing device the user chooses.

A Second Alternate Preferred Embodiment

Figure 8:
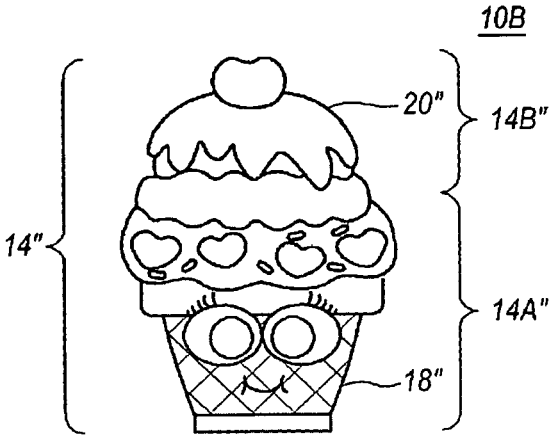
FIG. 8 is an exploded perspective view of a second alternate embodiment of the holder of the present invention.
Figure 9:
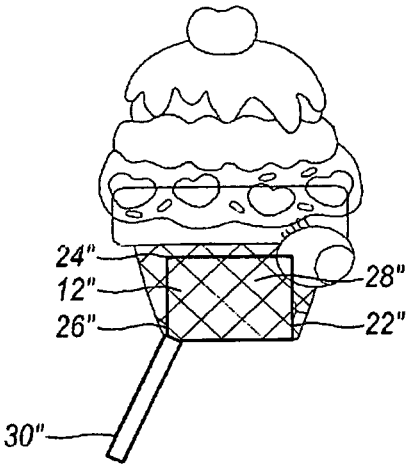
FIG. 9 is a cross-section view of a second alternate embodiment of the holder of the present invention.
Figure 10:
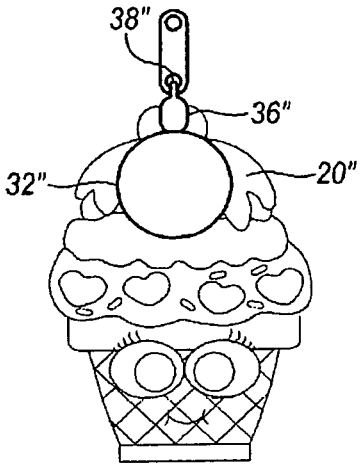
FIG. 10 is exploded cross-section view of a second alternate embodiment of the holder of the present invention.

FIGS. 8-10 illustrate a holder 10B in the shape of an ice cream cone. The holder 10B of the second alternate preferred embodiment, has a perimeter 14" is comprised of two portions, a container holding portion 18" and an attachment housing portion 20". The perimeter 14" is divided into the container holding portion perimeter 14A" and the attachment housing portion perimeter 14B". The container holding portion 18" includes a cavity 22" that is formed in a shape to conform to the shape of the container 12" it is to hold. The container 12" is comprised of a base wall 24" and a perimeter wall 26". The base wall 24" and the perimeter wall 26" define an interior space 28" for receiving any substance that may be contained therein. The container 12" further includes a cap portion 30" that is pivotably coupled to the perimeter wall 26" opposite of the base wall 24". The holder 10B is constructed of a suitable material that is capable of being molded into any pre-determined shape and to also snugly and/or non-removably hold the container 12" so that the container 12" does not fall out of the holder 10B. The material utilized for the holder 10B is also squeezable by a user. In addition the container 12" is retained in the holder 10B in such a fashion that the cap portion 30" is not covered by the holder 10B, thereby allowing a user to remove or replace the cap portion 30" on the container 12" without having to manipulate or remove the holder 10B from the container.

The attachment housing portion 20" of the holder 10B is used to accommodate a retractable reel assembly 32". The attachment housing portion 20" is defined by the perimeter 14B" and the interior housing wall 34". In this embodiment, the interior housing wall is thicker as in the alternate preferred embodiment. However, similarly, the interior housing wall 34" functions as the base wall for the cavity 22" and the other side functions to define the attachment housing portion 20". The reel assembly 32' of the holder 10B of the present invention includes a retractor cord 36" coupled to the reel assembly 32". The reel assembly 32" permits selective movement of the holder 10B when one pulls on the retractor cord 36". The retractor cord 36", when released after being pulled, retracts back into the reel assembly.

The perimeter wall 14B" of the attachment housing portion 20" includes an aperture 38" which allows the retractor cord 36" to extend within the housing portion 20" and be connected to the reel assembly 32". In this embodiment, the reel assembly 32" is substantially disk shaped, although other shapes may also be employed.

Ideal materials to be utilized in manufacturing the holder of the present invention should be those that are moldable and/or flexible and/or squeezable. Materials which are soft and/or flexible and/or pliable and/or moldable and/or pleasurable to the feel and encourage a user to engage their hands to alleviate nervousness, anxiety, increase motor function and/or for pleasure are ideal for constructing the holder of the present invention. The material for constructing the holder of the present invention should be capable of maintaining its shape while being handled extensively, be able to be dyed to any desired color or shade and generally be receptive to molding processes.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A holder for a container, said holder comprised of a perimeter, wherein said perimeter defines an interior space, and wherein said interior space is comprised of a container holding portion and an attachment housing portion, wherein said container holding portion includes a cavity conforming to the container, said cavity of said holder fully enclosing the exterior of the container covered by said holder, wherein said container is retained in the holder in a non-removable manner, and wherein said container includes a cap portion and said cap portion is not covered by the holder, wherein said cap portion is hingeably attached to said container, wherein said attachment housing portion is comprised of a retractable reel assembly and a retractor cord coupled to the retractable reel assembly, wherein said retractable reel assembly is situated within the attachment housing portion of the holder, and wherein the perimeter surrounding the attachment housing portion includes an aperture communicating with the exterior of the interior space, and wherein the retractor cord is threaded through the aperture while remaining connected to the retractor reel assembly, and wherein the reel assembly permits selective movement of the holder when one pulls on the retractor cord, and wherein said holder is comprised of a resilient material.

2. The holder of claim 1, said holder being comprised of a moldable material.

3. The holder of claim 1, said holder being comprised of a flexible material.

4. The holder of claim 1, said holder being comprised of a squeezable material.

* * * * *